US011448401B2

(12) United States Patent
Billman et al.

(10) Patent No.: US 11,448,401 B2
(45) Date of Patent: Sep. 20, 2022

(54) COOKING ASSEMBLY AND METHODS FOR PROTECTING UTENSILS THEREON

(71) Applicant: Haier US Appliance Solutions, Inc., Wilmington, DE (US)

(72) Inventors: David William Billman, Louisville, KY (US); John Mark Chilton, Campbellsburg, KY (US)

(73) Assignee: Haler US Appliance Solutions, Inc., Wilmington, DE (US)

( * ) Notice: Subject to any disclaimer, the term of this patent is extended or adjusted under 35 U.S.C. 154(b) by 799 days.

(21) Appl. No.: 16/245,575

(22) Filed: Jan. 11, 2019

(65) Prior Publication Data

US 2020/0224880 A1 Jul. 16, 2020

(51) Int. Cl.

| | |
|---|---|
| ***F24C 3/08*** | (2006.01) |
| ***F23N 5/08*** | (2006.01) |
| ***F23N 5/24*** | (2006.01) |
| ***F24C 3/12*** | (2006.01) |

(52) U.S. Cl.

CPC ..... *F24C 3/085* (2013.01); *F23N 5/082* (2013.01); *F23N 5/242* (2013.01); *F24C 3/124* (2013.01)

(58) Field of Classification Search

CPC ..... F24C 3/08; F24C 3/12; F24C 5/16; F24C 7/08; A47J 27/00; A47J 27/04; A47J 27/08; A47J 27/09; A47J 27/12; A47J 27/16; A47J 27/62; A47J 31/02; A47J 31/44; A47J 31/56; A47J 36/00; A47J 36/06; A47J 36/31; A47J 37/06; F23C 6/04; F23C 13/06; H05B 6/12; H05B 6/44; H05B 6/06; H05B 6/08; H05B 1/02; H05B 13/03; H05B 13/05; H05B 3/68; H05B 3/74; F23N 5/20; F23N 5/203; F23N 5/0222

See application file for complete search history.

(56) References Cited

U.S. PATENT DOCUMENTS

| | | | | |
|---|---|---|---|---|
| 9,006,622 | B2 | 4/2015 | Beverly et al. | |
| 10,092,129 | B2 * | 10/2018 | Jenkins | H05B 6/065 |
| 10,788,220 | B2 * | 9/2020 | Blum | H05B 6/06 |
| 11,140,751 | B2 * | 10/2021 | Baldo | H05B 6/065 |
| 2002/0175213 | A1 * | 11/2002 | Wodeslavsky | F24C 3/126 236/20 A |
| 2004/0016348 | A1 * | 1/2004 | Sharpe | A47J 36/321 99/422 |
| 2014/0295357 | A1 * | 10/2014 | McAfee | F24C 3/124 431/18 |
| 2016/0290655 | A1 * | 10/2016 | Moon | F24C 1/02 |
| 2017/0031337 | A1 * | 2/2017 | Jablokov | G05D 7/0635 |
| 2018/0017265 | A1 * | 1/2018 | Gelber | F24C 7/087 |
| 2019/0203942 | A1 * | 7/2019 | Green | F24C 3/124 |

FOREIGN PATENT DOCUMENTS

| | | | |
|---|---|---|---|
| CN | 207590470 U | * | 7/2018 |
| JP | 4342349 B2 | | 10/2009 |
| JP | 5775504 B2 | | 9/2015 |
| JP | 2018096607 A | * | 6/2018 |

* cited by examiner

*Primary Examiner* — David J Laux

(74) *Attorney, Agent, or Firm* — Dority & Manning, P.A.

(57) ABSTRACT

Cooking assemblies, such as cooktop appliances, including methods of operation thereof, are provided. A method of operating a cooktop appliance may include receiving a mode selection signal from a user interface of the cooktop appliance. The method may also include receiving a utensil signal from a cooking utensil positioned on a primary heating element and restricting heat generation at a secondary heating element or transmitting a notification signal.

19 Claims, 4 Drawing Sheets

COOKING ASSEMBLY AND METHODS FOR PROTECTING UTENSILS THEREON

FIELD OF THE INVENTION

The present subject matter relates generally to cooktop appliances and more particularly to methods for operating a cooktop appliance in a manner that prevents damage to a cooking utensil (e.g., pot, pan, skillet, etc.) positioned on the cooktop appliance.

BACKGROUND OF THE INVENTION

Cooktop or range appliances generally include heating elements for heating cooking utensils, such as pots, pans, and griddles. A variety of configurations can be used for the heating elements located on the cooking surface of the cooktop. The number of heating elements or positions available for heating on the range appliance can include, for example, four, six, or more depending upon the intended application and preferences of the buyer. These heating elements can vary in size, location, and capability across the appliance. Typically, the heating elements are controlled by a user interface mounted to the cooking appliance. The user interface often includes one or more control inputs, such as knobs and buttons, as well as a display for presenting information relevant to cooking operations, such as the temperature at corresponding heating element. A user is typically required to directly press or engage the control inputs in order to control operation of the cooking appliance. If a user is following a recipe, the user must often read how the cooking appliance is to be used (e.g., the temperature at which it must be set), and then manually direct the cooking appliance accordingly.

Recently, systems have been developed so that certain portions of a cooking task can be automated or performed with greater precision using one or more so-called "smart utensils." Often, these smart utensils incorporate or receive one or more electronic components (e.g., sensors) to communicate with, for instance, a cooktop appliance or separate device.

Although existing systems can provide improved precision and automation, the electronic nature of smart utensils leaves them at risk for damage. In many cases, the electronic components must be shielded or kept apart from the high heat often required during cooking. However, damage may still occur if, for instance, a heating element is activated in close proximity (e.g., next to) the heating element on which a smart utensil is placed.

As a result, there is a need for protecting utensils from damage. In particular, it would be advantageous to provide a system or method that permitted the use of a utensil having one or more electronic components, while still protecting the utensil from heat damage.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a cooktop appliance is provided. The method may include receiving a mode selection signal from a user interface of the cooktop appliance. The method may also include receiving a utensil signal from a cooking utensil positioned on a primary heating element and restricting heat generation at a secondary heating element based on the mode selection signal in response to receiving the utensil signal.

In another exemplary aspect of the present disclosure, a method of operating a cooktop appliance is provided. The method may include receiving a mode selection signal from a user interface of the cooktop appliance and receiving a utensil signal from a cooking utensil positioned on a primary heating element. The method may also include determining an operational condition of a secondary heating element in response to receiving the utensil signal and transmitting a notification signal to the user interface in response to determining the operational condition.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
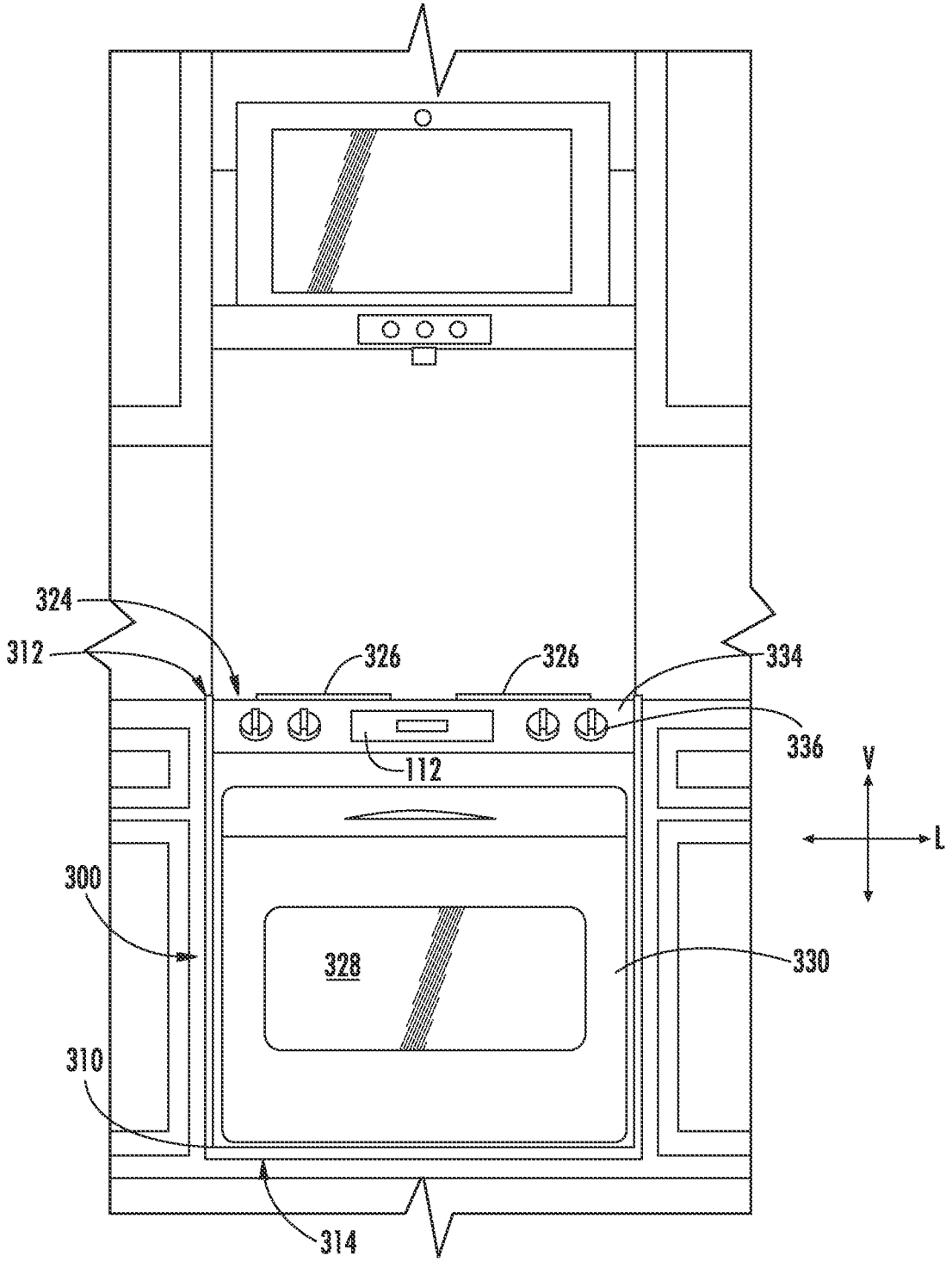
FIG. 1 provides a front perspective view of a system according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Generally, the present disclosure provides methods and systems for using a cooktop appliance while protecting a utensil on the cooktop appliance from heat from, for example, an adjacent heating element.

Figure 2:
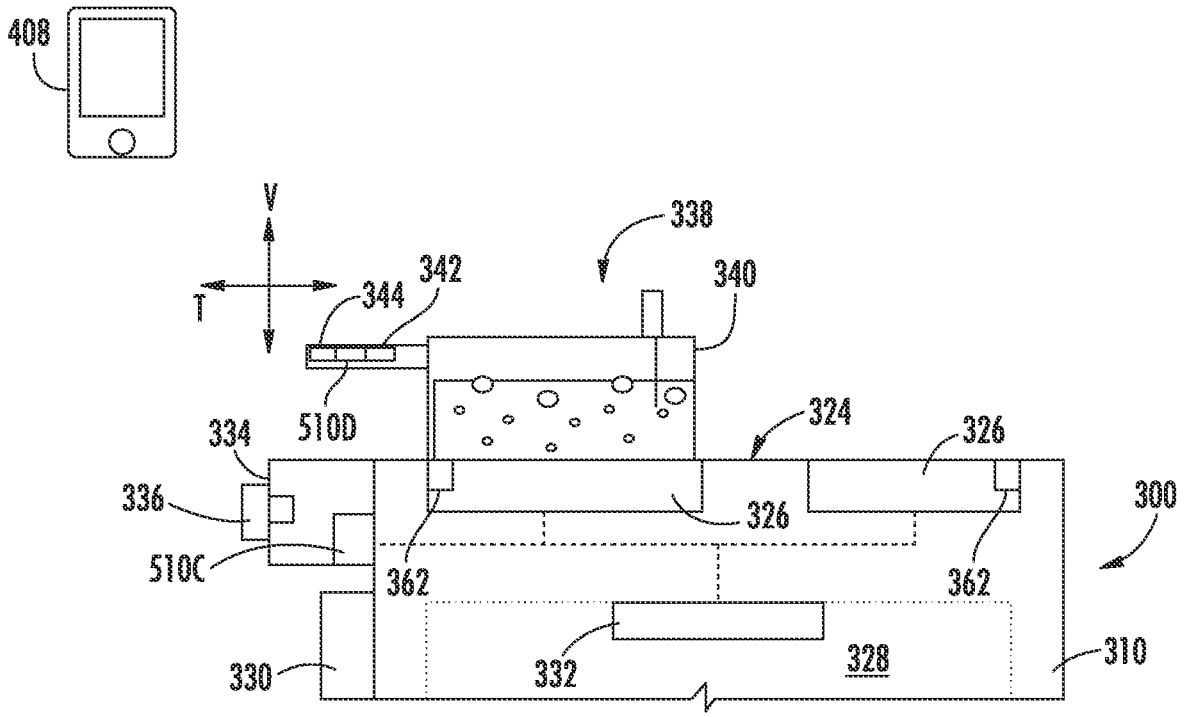
FIG. 2 provides a side schematic view of the exemplary system of FIG. 1.
Figure 3:
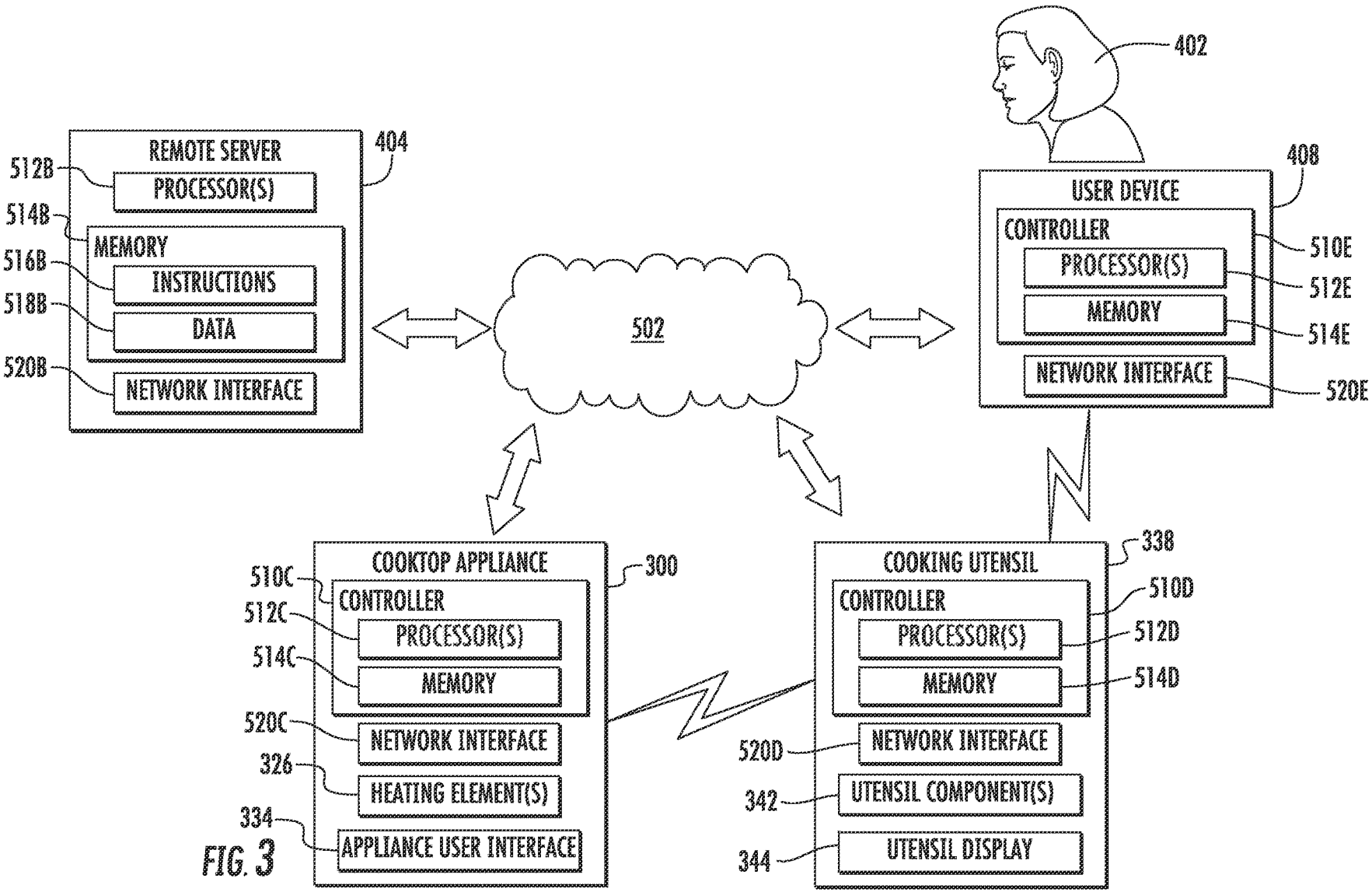
FIG. 3 provides a schematic view of a system for engaging a cooktop appliance according to exemplary embodiments of the present disclosure.

Turning now to the figures, FIGS. 1 through 3 provide various views of a system for controlling or operating a cooktop appliance 300 according to exemplary embodiments of the present disclosure. In some embodiments, along with cooktop appliance 300, the system includes a remote server 404 or user device 408, as will be further described below.

As shown cooktop appliance 300 defines a vertical direction V and one or more horizontal directions (e.g., a lateral direction L and a transverse direction T), for example, at a cabinet 310. The vertical, lateral, and transverse directions are mutually perpendicular and form an orthogonal direction system. As shown, cooktop appliance 300 extends along the vertical direction V between a top portion 312 and a bottom portion 314; along the lateral direction L between a left side portion and a right side portion; and along the traverse direction T between a front portion and a rear portion.

Cooktop appliance 300 can include a chassis or cabinet 310 and a cooktop surface 324 having one or more heating elements 326 for use in, for example, heating or cooking operations. In one example embodiment, cooktop surface 324 is constructed with ceramic glass. In other embodiments, however, cooktop surface 324 may include of another suitable material, such as a metallic material (e.g., steel) or another suitable non-metallic material. Heating elements 326 may be various sizes and may employ any suitable method for heating or cooking an object, such as a cooking utensil 338, and its contents. In some embodiments, for example, heating element 326 uses a heat transfer method, such as electric coils or gas burners, to heat the cooking utensil 338. Nonetheless, it is understood that heating element 326 may include a gas burner element, resistive heat element, radiant heat element, or another suitable heat-generating element. In certain embodiments, one or more sensors (e.g., detection sensor 362) are provided on or with each heating element 326. For instance, a temperature sensor or flame rectification sensor may be provided to detect or determine that the corresponding heating element 326 is active (i.e., actively generating heat), as would be understood.

In some embodiments, cooktop appliance 300 includes an insulated cabinet 310 that defines a cooking chamber 328 selectively covered by a door 330. One or more heating elements 332 (e.g., top broiling elements or bottom baking elements) may be enclosed within cabinet 310 to heat cooking chamber 328. Heating elements 332 within cooking chamber 328 may be provided as any suitable element for cooking the contents of cooking chamber 328, such as an electric resistive heating element, a gas burner, microwave element, halogen element, etc. Thus, cooktop appliance 300 may be referred to as an oven range appliance. As will be understood by those skilled in the art, cooktop appliance 300 is provided by way of example only, and the present subject matter may be used in any suitable cooking appliance, such as a double oven range appliance or a standalone cooktop (e.g., fitted integrally with a surface of a kitchen counter). Thus, the example embodiments illustrated in figures are not intended to limit the present subject matter to any particular cooking chamber or heating element configuration, except as otherwise indicated.

As illustrated, a user interface or interface panel 334 may be provided on cooktop appliance 300. Although shown at the front portion of cooktop appliance 300, another suitable location or structure (e.g., a backsplash) for supporting user interface panel 334 may be provided in alternative embodiments. In some embodiments, user interface panel 334 includes input components or controls 336, such as one or more of a variety of electrical, mechanical, or electromechanical input devices. Controls 336 may include, for example, rotary dials, knobs, push buttons, and touch pads. A controller 510C is in communication with user interface panel 334 and controls 336 through which a user may select various operational features and modes and monitor progress of cooktop appliance 300. In additional or alternative embodiments, user interface panel 334 includes a display component (e.g., image monitor 112), such as a digital or analog display in communication with a controller 510C and configured to provide operational feedback to a user. In certain embodiments, user interface panel 334 represents a general purpose I/O ("GPIO") device or functional block.

Generally, controller 510C can be positioned in any suitable location throughout cooktop appliance 300. For example, controller 510C may be located proximate to user interface panel 334 toward the front portion of cooktop appliance 300.

When assembled, controller 510C is communicatively coupled (i.e., in operative communication) with user interface panel 334, including controls 336 and image monitor 112. Controller 510C may also be communicatively coupled with various operational components of cooktop appliance 300, such as heating elements (e.g., 326, 332), sensors (e.g., detection sensors 362), etc. Input/output ("I/O") signals may be routed between controller 510C and the various operational components of cooktop appliance 300. Thus, controller 510C can selectively activate and operate these various components. Various components of cooktop appliance 300 are communicatively coupled with controller 510C via one or more communication lines such as, for example, conductive signal lines, shared communication busses, or wireless communications bands.

In some embodiments, an image monitor 112 is provided at or adjacent to cooktop appliance 300 (e.g., at or as part of the display component). For instance, image monitor 112 may be mounted to cabinet 310 (e.g., above cooking chamber 328). Generally, image monitor 112 may be any suitable type of mechanism for visually presenting a digital image or notification. For example, image monitor 112 may be a liquid crystal display (LCD), a plasma display panel (PDP), a cathode ray tube (CRT) display, etc. Thus, image monitor 112 includes an imaging surface (e.g., screen or display panel) at which the digital image or notification is presented or displayed (e.g., as an optically-viewable picture or lighted region) to a user.

The digital image or notification at image monitor 112 may correspond to any suitable signal or data received or stored by cooktop appliance 300 (e.g., at controller 510C). As an example, image monitor 112 may present information in the form of viewable text or images. As another example, image monitor 112 may present a graphical user interface (GUI) that allows a user to select or manipulate various operational features of cooktop appliance 300 or system. During use of such GUI embodiments, a user may engage, select, or adjust the image presented at image monitor 112 through any suitable input, such as controls 336, a voice-command microphone, associated touch panels (e.g., capacitance or resistance touch panel) or sensors overlaid across the imaging surface, etc.

In some embodiments, a cooking utensil 338 can be provided and used with cooktop appliance 300. Cooking utensil 338 may have one or more electronic components fixed or attached to a utensil body 340 of the cooking utensil 338 (e.g., portion of the utensil 338 on which food items are received) such that the utensil 338 and corresponding components are independently movable relative to cabinet 310.

In some such embodiments, one or more utensil components 342, such as a cooking sensor are included with cooking utensil 338 (e.g., within a handle of cooking utensil 338). For instance, a temperature sensor or probe (e.g., thermistor, thermocouple, etc.) may be mounted to utensil body 340. Within cooking utensil 338 (e.g., the handle) a controller 510D (FIG. 3) may further be provided. In optional embodiments, a separate utensil display 344 (FIG. 3), such as a display including one or more light sources (e.g., light emitting diodes—LEDs), is mounted to or within utensil body 340 to project one or more visible light emissions (e.g., to a user at cooktop appliance 300). In additional or alternative embodiments, a network interface 520D (FIG. 3) may be mounted to or within utensil body 340.

Turning especially to FIG. 3, a schematic view is provided of an exemplary system that includes cooktop appliance 300, cooking utensil 338, one or more remote servers 404, and one or more user devices 408. As shown, cooktop appliance 300 can be communicatively coupled with a network 502 and various other nodes, such as, a cooking utensil 338, a remote server 404, or a user device 408.

In some embodiments, controller 510C includes one or more memory devices 514C and one or more processors 512C. The processors 512C can be any suitable processing device (e.g., a processor core, a microprocessor, an ASIC, a FPGA, a microcontroller, etc.) and can be one processor or a plurality of processors that are operatively connected and can execute programming instructions or control code associated with operation of cooktop appliance 300. The memory devices 514C (i.e., memory) can include one or more non-transitory computer-readable storage mediums, such as RAM, ROM, EEPROM, EPROM, flash memory device, magnetic disks, etc., and combinations thereof. The memory devices 514C can store data and instructions that are executed by the processor 512C to cause cooktop appliance 300 to perform operations. In one embodiment, the processor 512C executes programming instructions stored in memory 514C. The memory 514C may be a separate component from the processor 512C or may be included onboard within the processor 512C.

Controller 510C includes a network interface 520C such that controller 510C can connect to and communicate over one or more networks (e.g., network 502) with one or more network nodes. Controller 510C can also include one or more transmitting, receiving, or transceiving components for transmitting/receiving communications with other devices communicatively coupled with cooktop appliance 300. Additionally or alternatively, one or more transmitting, receiving, or transceiving components can be located off board controller 510C.

Network 502 can be any suitable type of network, such as a local area network (e.g., intranet), wide area network (e.g., internet), low power wireless networks [e.g., Bluetooth Low Energy (BLE)], or some combination thereof and can include any number of wired or wireless links. In general, communication over network 502 can be carried via any type of wired or wireless connection, using a wide variety of communication protocols (e.g., TCP/IP, HTTP, SMTP, FTP), encodings or formats (e.g., HTML, XML), or protection schemes (e.g., VPN, secure HTTP, SSL).

As noted above, cooking utensil 338 may include a controller 510D. In some such embodiments, controller 510D includes one or more memory devices 514D and one or more processors 512D. The processors 512D can be any combination of general or special purpose processors, CPUs, or the like that can execute programming instructions or control code associated with operation of cooking utensil 338. The memory devices 514D (i.e., memory) may represent random access memory such as DRAM or read only memory such as ROM or FLASH. In one embodiment, the processor 512D executes programming instructions stored in memory 514D. The memory 514D may be a separate component from the processor 512D or may be included onboard within the processor 512D. Alternatively, controller 510D may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, controller 510D includes a network interface 520D such that controller 510D can connect to and communicate over one or more networks (e.g., network 502) with one or more network nodes. Controller 510D can also include one or more transmitting, receiving, or transceiving components for transmitting/receiving communications with other devices operably or communicatively coupled with cooking utensil 338. Additionally or alternatively, one or more transmitting, receiving, or transceiving components can be located off board controller 510D.

In optional embodiments, a remote server 404, such as a web server, is in operative communication with cooktop appliance 300. The server 404 can be used to host an information database (e.g., recipe database, historical appliance use database, etc.). The server can be implemented using any suitable computing device(s). The server 404 may include one or more processors 512B and one or more memory devices 514B (i.e., memory). The one or more processors 512B can be any suitable processing device (e.g., a processor core, a microprocessor, an ASIC, a FPGA, a microcontroller, etc.) and can be one processor or a plurality of processors that are operatively connected. The memory device 512B can include one or more non-transitory computer-readable storage mediums, such as RAM, ROM, EEPROM, EPROM, flash memory devices, magnetic disks, etc., and combinations thereof. The memory devices 514B can store data 518B and instructions 516B which are executed by the processor 512B to cause remote server 404 to perform operations. For example, instructions 516B could be instructions for transmitting/receiving recipe signals, notification signals, utensil signals, mode selection signals, etc.

The memory devices 514B may also include data 518B, such as recipe data, notification data, utensil data, historical use data, etc., that can be retrieved, manipulated, created, or stored by processor 512B. The data 518B can be stored in one or more databases. The one or more databases can be connected to remote server 404 by a high bandwidth LAN or WAN, or can also be connected to remote server 404 through network 502. The one or more databases can be split up so that they are located in multiple locales.

Remote server 404 includes a network interface 520B such that remote server 404 can connect to and communicate over one or more networks (e.g., network 502) with one or more network nodes. Network interface 520B can be an onboard component or it can be a separate, off board component. In turn, remote server 404 can exchange data with one or more nodes over the network 502. In particular, remote server 404 can exchange data with cooktop appliance 300, user device 408, or cooking utensil 338.

In certain embodiments, a user device 408 is communicatively coupled with network 502 such that user device 408 can communicate with cooktop appliance 300. For instance, user device 408 can communicate directly with cooktop appliance 300 via network 502. Alternatively, a user can communicate indirectly with cooktop appliance 300 by communicating via network 502 with remote server 404 (e.g., directly or indirectly through one or more intermediate remote servers), which in turn communicates with cooktop appliance 300 via network 502. Moreover, a user 402 can be in operative communication with user device 408 such that the user 402 can communicate with cooktop appliance 300 via user device 408.

User device 408 can be any type of device, such as, for example, a personal computing device (e.g., laptop or desktop), a mobile computing device (e.g., smartphone or tablet), a gaming console or controller, a wearable computing device, an embedded computing device, a remote, or any other suitable type of user computing device that is separate from [e.g., independently movable and spaced apart relative to cabinet 310 (FIG. 2) of cooktop appliance 300]. User device 408 can include one or more user device controllers 510E. Controller 510E can include one or more processors 512E and one or more memory devices 514E. The one or more processors 512E can be any suitable processing device (e.g., a processor core, a microprocessor, an ASIC, a FPGA, a controller, a microcontroller, etc.) and can be one processor or a plurality of processors that are operatively connected. The memory device (i.e., memory) can include one or more non-transitory computer-readable storage mediums, such as RAM, ROM, EEPROM, EPROM, flash memory devices, magnetic disks, etc., and combinations thereof. The memory can store data and instructions which are executed by the processor 512E to cause user device 408 to perform operations. Controller 510E can include a user device network interface 520E such that user device 408 can connect to and communicate over one or more networks (e.g., network 502) with one or more network nodes. Network interface 520E can be an onboard component of controller 510E or it can be a separate, off board component. Controller 510E can also include one or more transmitting, receiving, or transceiving components for transmitting/receiving communications (e.g., notification signals, mode selection signals, utensil signals, etc.) with other devices communicatively coupled with user device 408. Additionally or alternatively, one or more transmitting, receiving, or transceiving components can be located off board controller 510E.

User device 408 can include one or more user inputs such as, for example, buttons, one or more cameras, or a monitor configured to display graphical user interfaces or other visual representations to user (e.g., to serve as, or as a part of, the user interface for the cooktop appliance 300). For example, the monitor of the user device 408 can display graphical user interfaces corresponding to operational features of cooktop appliance 300 such that user 402 may manipulate or select the features to operate cooktop appliance 300. In some such embodiments, the graphical user interface on the user device 408 can display information (e.g., temperature information, cook time information, progress information, etc.) corresponding to cooking utensil 338.

The monitor of the user device 408 can be a touch sensitive component (e.g., a touch-sensitive display screen or a touch pad) that is sensitive to the touch of a user input object (e.g., a finger or a stylus). For example, a user 402 may touch the monitor of the user device 408 with his or her finger and type in a series of numbers on the monitor. In addition, motion of the user input object relative to the monitor of the user device 408 can enable user 402 to provide input to user device 408. User device 408 may provide other suitable methods for providing input to user device 408 as well. Moreover, user device 408 can include one or more speakers, one or more cameras, or more than one microphones such that user device 408 is configured with voice control, motion detection, and other functionality.

Generally, a user 402 may be in operative communication with cooktop appliance 300 or one or more user devices 408. For instance, a user 402 may wish to alternately operate cooktop appliance 300 locally (e.g., through inputs 336) or remotely (e.g., through user device 408). In particular, a user 402 may wish to control operational features that include activating portions of cooktop appliance 300, selecting a temperature or heat setting for cooktop appliance 300, etc. In additional or alternative embodiments, user 402 can communicate with devices (e.g., cooktop appliance 300) using, for example, voice control. User 402 may also be in operative communication via other methods as well, such as visual communication Referring now to FIGS. 4 and 5, various methods may be provided for use with a system in accordance with the present disclosure. In general, the various steps of methods as disclosed herein may, in exemplary embodiments, be performed by a controller (e.g., controller 510C) as part of an operation that the controller is configured to initiate (e.g., a cooking operation). During such methods, the controller may receive inputs and transmit outputs from various other components of the system. For example, the controller 510C may send signals to and receive signals from cooking utensil 338, remote server 404, or user device 408. In particular, the present disclosure is further directed to methods, as indicated by 600 or 700, for operating a cooktop appliance 300. Such methods advantageously protect a cooking utensil 338 (e.g., by preventing accidental operation of an adjacent heating element 326). In particular, it is notable that the described methods may provide a selective or optional method of operating a cooktop appliance 300 that does not prevent alternative operations wherein multiple heating elements 326 may be activated. Moreover, the described methods advantageously do not require constant monitoring by a user to ensure portions of a cooking utensil 338 are not inadvertently placed in a high-heat environment.

In certain embodiments, cooktop appliance 300 is in operative communication with user device 408 via network 502. In turn, controller 510C of cooktop appliance 300 may exchange signals with user device 408. Optionally, one or more portions of cooktop appliance 300 may be controlled according to signals received from user device 408 (e.g., through one or more intermediate remote servers, remote sensor 404, or both).

Figure 4:
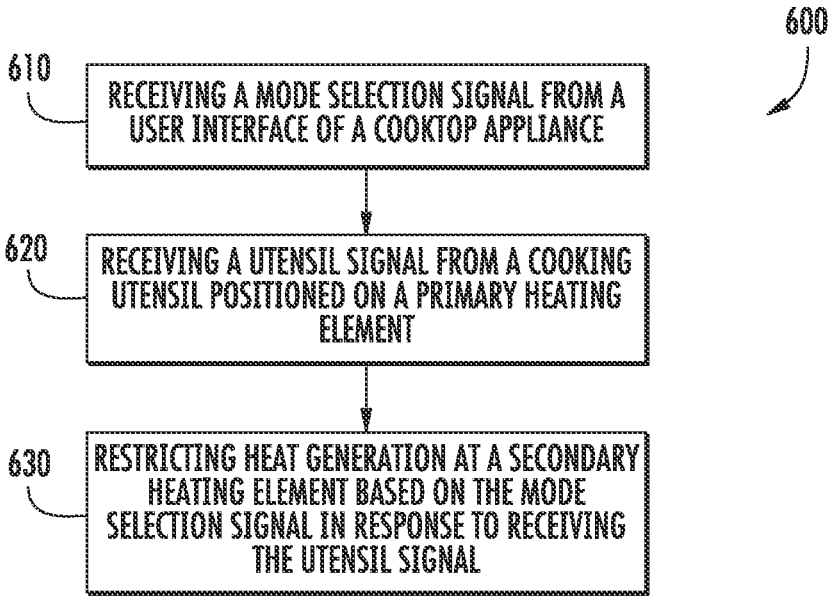
FIG. 4 provides a flow chart illustrating a method of operating a system according to exemplary embodiments of the present disclosure.

Turning now to FIG. 4, at 610, the method 600 includes receiving a mode selection signal from a user interface of the cooktop appliance. As an example, the mode selection signal may be received in response to an action or input provided from a user at the user interface panel of the cooktop appliance. As another example, the mode selection signal may be received in response to an action or input provided from a user at the user device.

In some embodiments, the mode selection signal indicates that a user has selected a specific operational mode for or on a cooktop appliance, such as a precision cooking mode. Optionally, the precision cooking mode may include designating one of the heating elements of the cooktop appliance as a primary heating element. Heat generated at the primary heating element (e.g., a magnitude or temperature of the heat generated by the primary heating element, the duration or time for which heat is generated by the primary heating element, etc.) may be contingent upon conditions, such as temperature, detected at one or more sensors (e.g., on or within a cooking utensil, as described above).

At 620, the method 600 includes receiving a utensil signal from a cooking utensil positioned on the primary heating element. Specifically, this utensil signal may be received through an intermediate or common network (e.g., from the cooking utensil), as described above. Moreover, the utensil signal may be received by the cooktop appliance and confirm that a wireless connection has been established (e.g., such that wireless communication between the cooking utensil in the cooktop appliance is permitted). In some embodiments, 620 follows (i.e., occurs subsequent to) 610. In alternative embodiments, however, 610 follows 620.

At 630, the method 600 includes restricting heat generation at a secondary heating element. As described above, the cooktop appliance includes multiple heating elements spaced apart from, and not coaxial with, each other (e.g., along a horizontal direction, such as a lateral or transverse direction). Thus, the secondary heating element is understood to be a separate heating element from the primary heating element that it is horizontally spaced apart from on the cooktop appliance. In certain embodiments, the secondary heating element is adjacent to the primary heating element. In other words, there is no other heating element positioned between the primary heating element and the secondary heating element (e.g., along a lateral direction or a transverse direction on the cooktop surface of the cooktop appliance).

Generally, the restriction of 630 is based on the mode selection signal at 610 and may be initiated in response to receiving the utensil signal at 620. Thus, 630 requires 610 and 620 to be performed prior to restricting heat generation at the secondary heating element. In some embodiments, the restriction of 630 prevents activation of the secondary heating element. As an example, in the case of a gas burner heating element, 630 may include closing a supply valve for fuel or gas to the secondary heating element, as would be understood. As another example, in the case of an electric heating element, 630 may include halting or preventing an electrical current from being supplied to the secondary heating element (e.g., such that resistive or radiant heat is not generated at the secondary heating element).

In some embodiments, the method 600 further includes receiving a status signal from a sensor positioned at the secondary heating element. For instance, a detection sensor may be provided at the secondary heating element, as described above. The detection sensor may be configured to transmit a status signal in response to detecting the presence (or lack thereof) of a utensil at the secondary heating element. Receiving the status signal may be followed by a determination that the secondary heating element is inactive. Optionally, 630 may be conditioned or contingent upon receiving a status signal indicating that the secondary heating element is inactive. Additionally or alternatively, a notification signal may be transmitted to the user interface (e.g., user interface panel or user device) based on the status signal. The notification signal may be transmitted with or subsequent to 630.

In additional or alternative embodiments, the method 600 further includes receiving a temperature signal from a temperature sensor that is engaged with (e.g., mounted or attached to) the cooking utensil. Based on the received temperature signal, a determination may be made that the primary heating element is active. Moreover, further confirmation may be established that the cooking utensil is connected to, or in communication with, the cooktop appliance. Optionally, 630 may be conditioned or contingent upon receiving a temperature signal indicating that the primary heating element is active. Additionally or alternatively, a notification signal may be transmitted to the user interface (e.g., user interface panel or user device) based on the temperature signal. The notification signal may be transmitted with or subsequent to 630.

Figure 5:
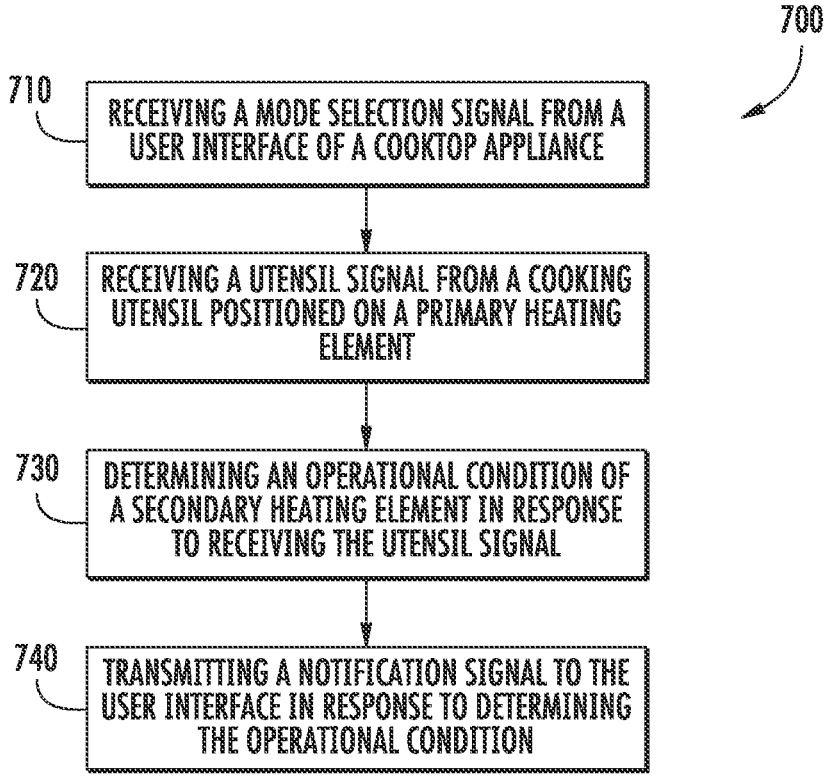
FIG. 5 provides a flow chart illustrating a method of operating a system according to other exemplary embodiments of the present disclosure.

Turning specifically to FIG. 5, at 710, the method 700 includes receiving a mode selection signal from a user interface of the cooktop appliance. As an example, the mode selection signal may be received in response to an action or input provided from a user at the user interface panel of the cooktop appliance. As another example, the mode selection signal may be received in response to an action or input provided from a user at the user device.

In some embodiments, the mode selection signal indicates that a user has selected a specific operational mode with a cooktop appliance, such as a precision cooking mode. Optionally, the precision cooking mode may include designating one of the heating elements of the cooktop appliance as a primary heating element. Heat generated at the primary heating element (e.g., a magnitude or temperature of the heat generated by the primary heating element, the duration or time for which heat is generated by the primary heating element, etc.) may be contingent upon conditions, such as temperature, detected at one or more sensors (e.g., on or within a cooking utensil, as described above).

At 720, the method 700 includes receiving a utensil signal from a cooking utensil positioned on the primary heating element. Specifically, this utensil signal may be received through an intermediate or common network (e.g., from the cooking utensil), as described above. Moreover, the utensil signal may be received by the cooktop appliance and confirm that a wireless connection has been established (e.g., such that wireless communication between the cooking utensil in the cooktop appliance is permitted). In some embodiments, 720 follows (i.e., occurs subsequent to) 710. In alternative embodiments, however, 710 follows 720.

At 730, the method 700 includes determining an operational condition of the secondary heating element in response to receiving the utensil signal. In some embodiments, 730 includes receiving a status signal from a sensor positioned at the secondary heating element. For instance, a detection sensor may be provided at the secondary heating element, as described above. Receiving the status signal may be followed by a determination that the secondary heating element is either active or, alternately, inactive.

At 740, the method 700 includes transmitting a notification signal to the user interface (e.g., user interface panel or user device) in response to determining the operational condition. For instance, the notification signal may be based on the received status signal and determination as to whether the secondary heating element is active or inactive.

If the secondary heating element is active, the notification signal may include text or a visual representation of the same (e.g., to be displayed at the image monitor of the cooktop appliance or the display of the user device). Additionally or alternatively, the cooktop appliance may be prevented from entering a particular operational mode. Furthermore, 730 and 740 may the secondary heating element be repeated (e.g., according to a predetermined cycle or step cycle in order to provide an updated determination on the operational condition).

If the secondary heating element is inactive, the notification signal may include text or visual representation of the same (e.g., to be displayed at the image monitor of the cooktop appliance or the display of the user device). Additionally or alternatively, heat generation at the secondary heating element may be restricted. In some embodiments, the restriction prevents activation of the secondary heating element. As an example, in the case of a gas burner heating element, restriction may include closing a supply valve for fuel or gas to the secondary heating element, as would be understood. As another example, in the case of an electric heating element, restriction may include halting or preventing an electrical current from being supplied to the secondary heating element (e.g., such that resistive or radiant heat is not generated at the secondary heating element).

In certain embodiments, the method 700 further includes receiving a temperature signal from a temperature sensor that is engaged with (e.g., mounted or attached to) the cooking utensil. Based on the received temperature signal, a determination may be made that the primary heating element is active. Moreover, further confirmation may be established that the cooking utensil is connected to or in communication with the cooktop appliance. Optionally, 730 may be conditioned or contingent upon receiving a temperature signal indicating that the primary heating element is active. Additionally or alternatively, a notification signal may be transmitted to the user interface (e.g., user interface panel or user device) based on the temperature signal. This notification signal may be transmitted as, with, or subsequent to the notification signal of 740.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a cooktop appliance defining a vertical direction and a horizontal direction, the cooktop appliance comprising a primary heating element and a secondary heating element spaced apart from the primary heating element along the horizontal direction, the method comprising:

receiving a mode selection signal from a user interface of the cooktop appliance indicating a precision cooking mode for the primary heating element;

receiving a utensil signal from a cooking utensil positioned on the primary heating element; and restricting heat generation at the secondary heating element based on the mode selection signal in response to receiving the utensil signal while the primary heating element is active in the precision cooking mode.

2. The method of claim 1, further comprising receiving a status signal from a sensor positioned at the secondary heating element.

3. The method of claim 2, further comprising transmitting a notification signal to the user interface based on the received status signal.

4. The method of claim 1, further comprising receiving a temperature signal from a temperature sensor engaged with the cooking utensil.

5. The method of claim 4, further comprising transmitting a notification signal to the user interface based on the received temperature signal.

6. The method of claim 1, wherein the primary heating element is a first gas burner, and wherein the secondary heating element is a second gas burner.

7. The method of claim 1, wherein the primary heating element is a first electric heating element, and wherein the secondary heating element is a second electric heating element.

8. The method of claim 1, further comprising:

determining an operational condition of the secondary heating element in response to receiving the utensil signal; and transmitting a notification signal to the user interface in response to determining the operational condition.

9. The method of claim 8, wherein the cooktop appliance comprises a cabinet on which the primary heating element and the secondary heating element are mounted, wherein the user interface comprises a user device independently spaced apart from the cabinet, and wherein the notification signal is received at the user device.

10. The method of claim 8, wherein the cooktop appliance comprises a cabinet on which the primary heating element and the secondary heating element are mounted, wherein the user interface comprises a display panel fixed to the cabinet, and wherein the notification signal is received at the display panel.

11. A method of operating a cooktop appliance defining a vertical direction and a horizontal direction, the cooktop appliance comprising a primary heating element and a secondary heating element spaced apart from the primary heating element along the horizontal direction, the method comprising:

receiving a mode selection signal from a user interface of the cooktop appliance indicating a precision cooking mode for the primary heating element;

receiving a utensil signal from a cooking utensil positioned on the primary heating element, the utensil signal confirming that a wireless connection has been established between the cooktop appliance and the cooking utensil;

determining an operational condition of the secondary heating element response to receiving the utensil signal; and transmitting a notification signal to the user interface in response to determining the operational condition while the primary heating element is active.

12. The method of claim 11, wherein determining the operational condition comprises receiving a status signal from a sensor positioned at the secondary heating element.

13. The method of claim 12, wherein the notification signal is based on the received status signal.

14. The method of claim 11, further comprising receiving a temperature signal from a temperature sensor engaged with the cooking utensil.

15. The method of claim 14, wherein the notification signal is based on the received temperature signal.

16. The method of claim 11, wherein the primary heating element is a first gas burner, and wherein the secondary heating element is a second gas burner.

17. The method of claim 11, wherein the primary heating element is a first electric heating element, and wherein the secondary heating element is a second electric heating element.

18. The method of claim 11, wherein the cooktop appliance comprises a cabinet on which the primary heating element and the secondary heating element are mounted, wherein the user interface comprises a user device independently spaced apart from the cabinet, and wherein the notification signal is received at the user device.

19. The method of claim 11, wherein the cooktop appliance comprises a cabinet on which the primary heating element and the secondary heating element are mounted, wherein the user interface comprises a display panel fixed to the cabinet, and wherein the notification signal is received at the display panel.

* * * * *